United States Patent [19]

Haener

[11] Patent Number: 4,854,097

[45] Date of Patent: Aug. 8, 1989

[54] INSULATED INTERLOCKING BUILDING BLOCKS

[76] Inventor: Juan Haener, 8215 Harton Pl., San Diego, Calif. 92123

[21] Appl. No.: 151,238

[22] Filed: Feb. 1, 1988

[51] Int. Cl.[4] ..... E04C 1/00

[52] U.S. Cl. ..... 52/309.11; 52/405; 52/439; 52/505; 52/612

[58] Field of Search ..... 52/418, 419, 422, 426, 52/309.12, 284, 286, 439, 505, 562, 405, 309.11, 612, 563

[56] References Cited

U.S. PATENT DOCUMENTS

| | | | |
|---|---|---|---|
| 3,982,369 | 9/1976 | Keleske | 52/612 X |
| 4,262,463 | 4/1981 | Hapel | 52/505 X |
| 4,285,181 | 8/1981 | Van Loghem et al. | 52/309.11 X |
| 4,341,049 | 7/1982 | Hsi | 52/439 X |
| 4,640,071 | 2/1987 | Haener | 52/100 X |
| 4,745,720 | 5/1988 | Taylor | 52/563 X |
| 4,769,964 | 9/1988 | Johnson et al. | 52/405 |

*Primary Examiner*—Carl D. Friedman
*Assistant Examiner*—Creighton Smith
*Attorney, Agent, or Firm*—Frank D. Gilliam

[57] ABSTRACT

A building block having improved insulating characteristics. The block includes two spaced parallel sidewalls formed from concrete or the like. The first sidewall has at least one inwardly extending integral web, having end portions extending parallel to the sidewall. The second sidewall has inwardly extending interlock members which also have end portions extending parallel to the sidewall. When the sidewalls are assembled parallel to each other to form the front and back faces of the building block, the respective end portions overlap in a manner preventing the sidewalls from moving apart along a line perpendicular to the sidewalls. The overlapping end portions are not in contact with each other. At least part of the volume within the block is filled with a highly insulating foam. The foam fills the space between the overlapping end portions and thus provides structural rigidity to the block. The block has outstanding insulating properties since there are no thermal bridges of block structural material from one sidewall to the other. In the event of fire which melts or destroys the foam material, general structural integrity of a wall built from these blocks is assured by the overlapping end portions which prevent separation of the sidewalls.

15 Claims, 3 Drawing Sheets

INSULATED INTERLOCKING BUILDING BLOCKS

BACKGROUND OF THE INVENTION

This invention relates in general to structural building blocks and, more specifically, to blocks having greatly improved thermal insulating properties while retaining structural integrity in the event of a fire.

Building blocks made from concrete or the like have long been used in construction of walls, buildings, etc. Generally the blocks are rectangular in shape, with parallel vertical faces and vertical open cells therethrough. Blocks can be assembled with layers of mortar between adjacent surfaces, or the blocks may incorporate various keying arrangements which allow mortarless construction. Generally, once a wall or portion thereof is assembled, at least some of the open cells are filled with concrete with steel reinforcing rods running through the concrete in the cells. Such walls are sturdy, long lasting and generally economical to erect. However, the thermal insulating characteristics of such walls is rather low and wasteful of energy in heating or cooling a building using such walls.

Insulating panels are often added on one or both sides of block walls to increase insulating efficiency. Such additions, while often effective, add to wall thickness, are costly in materials and erection time and sometimes fail due to poor bonding, differential thermal expansion, etc.

Attempts have been made to incorporate foam or fibrous insulation material into the blocks themselves. For example, the block cells may be filled with an insulating foam. However, the block webs between cells still act as thermal energy bridges, so that the foam filled blocks are only slightly more efficient than air filled cells. Also, building codes often require that many cells be filled with concrete and reinforcing rods, reducing the erfectiveness of the few remaining foam filled cells.

Foam sleeves or inserts are available from Korfil incorporated in a "U"—shape which cover three walls of a block cell. These allow the center of the cell to be filled with reinforcing material. While showing some improvement in block insulating characteristics, these inserts do not overcome the problem of block webs acting as thermal bridges.

Attempts have been made to laminate or sandwich foam sheets between thin concrete blocks to make standard blocks. While these overcome the thermal bridging problem, they require a number of additional manufacturing steps beyond those for a standard block. Laminated blocks tend to have low strength and may suffer failures at the glue bond line. Also, in the event of fire, many foam material easily melt or burn, destroying the structural integrity of the block which may result in failure of the wall.

Thus, there is a continuing need for improved building blocks which have improved thermal insulating qualities, are simple and inexpensive to construct and assemble and have high strength and structural integrity, even when exposed to high heat or fires.

SUMMARY OF THE INVENTION

The above-noted problems, and others, are overcome by the building block of this invention which basically comprises a pair of spaced sidewalls having substantially parallel, generally planar outside surfaces and webs or other means extending inward from the sidewalls which have lateral end portions extending substantially parallel to the block faces in an interlocking but non-contacting relationship. At least a portion of the volume within the block is filled with a highly insulating foam material. The foam fills at least the region between the interlocking but non-contacting end portions. Generally, at least some vertical open space is left in each block to permit filling of an assembled wall with concrete and reinforcing rods.

These blocks are manufactured by molding each sidewall with any webs and inter-block key means in a conventional molding machine. The two sidewalls are then positioned and held in the desired spaced relationship, providing the desired outside dimensions but with the interlocking means out of contact. Foam is then introduced into the block, particularly into the region of the overlapping, interlocking end portions. Conventional removable mold members or cores may be positioned in the block to prevent foam from filling regions desired to be kept open.

Generally, vertical open channels will be retained to permit filling with concrete and insertion of reinforcing rods in walls assembled from the blocks. Further, molding cores can be inserted as desired to maintain open channels for the later insertion of pipes, wires or the like in an assembled wall. Also, channels through the foam can conveniently be used as ducts for heating or cooling fluids, such as heated or cooled air, since the foam will also serve to insulate those ducts.

Blocks constructed according to my invention may be configured for assembly with mortar or by mortarless assembly methods. As detailed below, I provide inter-block keys and connections aiding precise motarless assembly. If mortar is to be used, the height and length of the blocks could simply be reduced slightly to provide for the mortar layer, and the inter-block keys could be eliminated, if desired.

The foam can be inserted in the form of pre-molded blocks, a liquid or dry foamable material (which typically may be heated to cause foaming in place) or a pre-expanded self-foaming liquid foam material may be poured or sprayed in and cured.

BRIEF DESCRIPTION OF THE DRAWING FIGURES

Details of my invention, and of certain preferred embodiments thereof, will be further understood upon reference to the drawing, wherein.

DETAILED DESCRIPTION OF THE INVENTION

Figure 1:
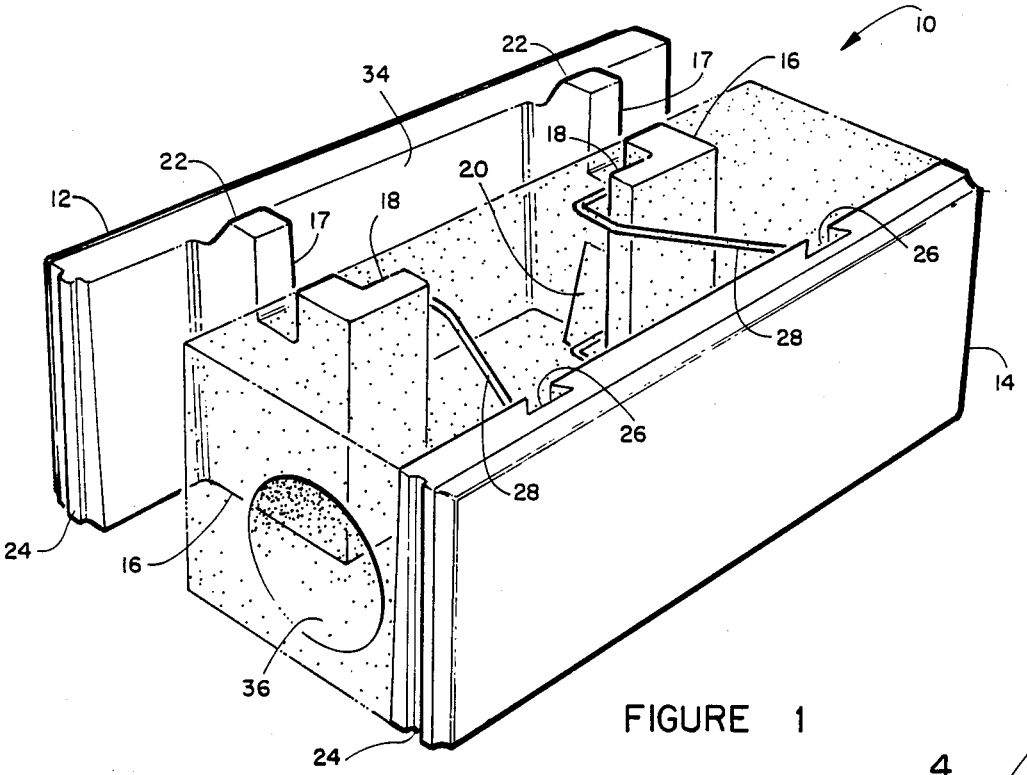
FIG. 1 is a perspective view, partially in phantom, showing a first embodiment of my improved building block.
Figure 3:
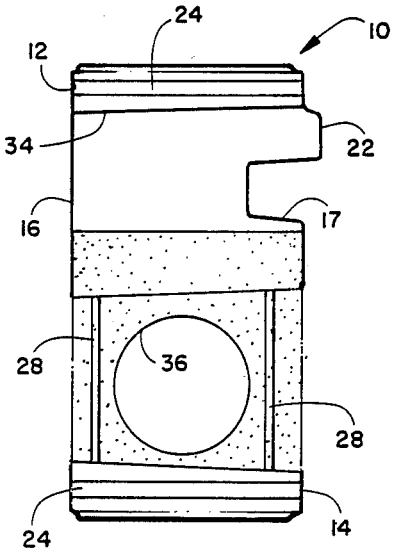
FIG. 3 is a left elevation view of the block of FIG. 1.

Referring now to FIGS. 1–4, there is seen a first preferred embodiment of an insulated building block 10. In this embodiment, block 10 basically comprises a first sidewall 12 and a second sidewall 14.

First sidewall 12 includes a pair of integral inwardly extending webs 16 which may have any suitable configuration. Each web 16 has an end portion 18 extending a short distance substantially parallel to the outer face of sidewall 12.

As is detailed below, each web has a concave upper edge notch 17 and a corresponding convex lower edge extension 20 to aid in locking adjacent blocks together in assembling a wall. Small, upwardly directed projections 22 also assist in locking adjacent block courses together. For similar reasons, the ends of sidewalls 12 and 14 may have a tongue-and-groove configuration 24 to interlock ends of adjacent blocks during assembly of a wall. While the embodiment shown is particularly adapted to mortarless wall assembly, if desired a smooth, flat block top and ends may be used with a blocks having lengths and heights about ⅜ inch, less to permit assembly using mortar in a conventional manner.

Second sidewall 14 has a pair of vertical dovetail grooves 26 extending across the inner surface. For the purposes of this application, "dovetail" includes any groove wider below the surface opening to retain an interlocking means as described herein. A pair of spring wires 28 are each bent into the configuration shown in FIG. 5, with a zig-zag center region 30 and hook like ends 32. The zig-zag center regions 30 is sized to slip snugly into grooves 24 from the top or bottom of sidewall 14 and be retained therein. Once in place, the ends 32 lie generally parallel to the surface of sidewall 14.

Figure 2:
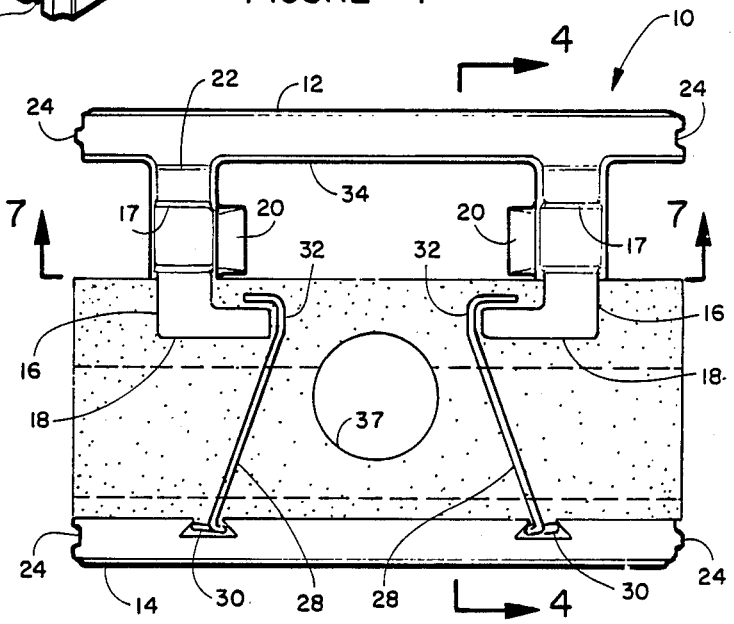
FIG. 2 is a plan view of the block of FIG. 1.

Sidewalls 12 and 14 are positioned with their outer surfaces parallel and spaced apart a distance equal to the desired block width. As best seen in FIG. 2, wires 28 are configured so that ends 32 overlap web ends 18 but are not in contact therewith. This overlap prevents the sidewalls from being moved apart along a line perpendicular to the sidewall outer surfaces more than a very small distance.

Figure 5:
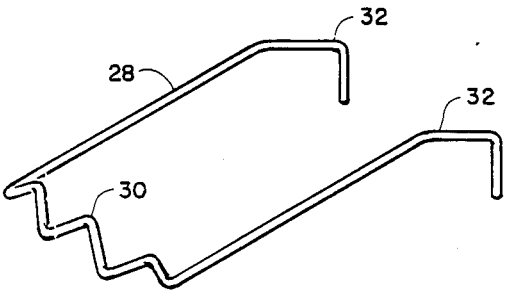
FIG. 5 is a detail perspective view of the interconnecting means of the block of FIG. 1.
Figure 4:
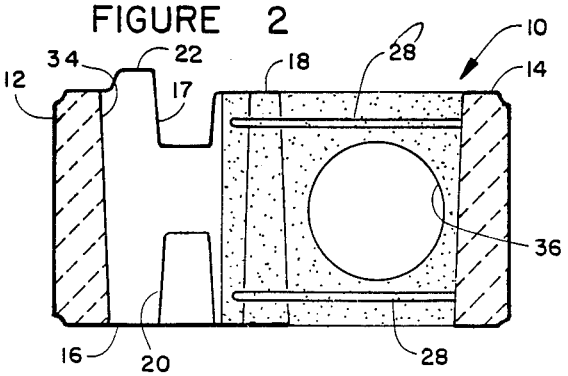
FIG. 4 is a section view taken of line 4—4 in FIG. 2.
Figure 6:
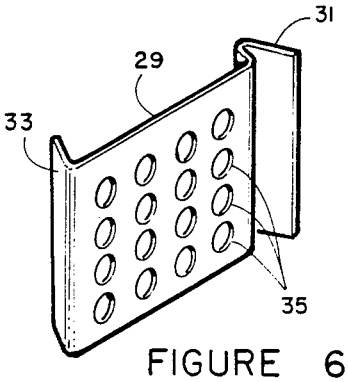
FIG. 6 is a detail perspective view of an alternate interconnecting means to that shown in FIG. 1.

If desired, a formed sheet (which may be metal, reinforced plastic or the like) interlocking means 29 as seen in FIG. 6 may be used in place of the wires 28 shown in FIG. 5. One end of sheet 29 is folded to fit within a dovetail slot 26. The other end is bent to lie parallel to the sidewall when installed in slot 26. Holes 35 may be formed in sheet 29 to lighten the sheet and provide better bonding to the foam.

After the sidewalls and interlocking means are assembled, the open space within the block 10 can be partially or entirely filled with a foam material 33. While the foam material will in practice be opaque, it has been shown in phantom so that other components of the assembly can be clearly seen and understood. The foam may be emplaced using any conventional technique, such as pouring a liquid foam into the cavity and allowing it to cure, placing a dry or liquid foamable material in the cavity and heating or otherwise treating the material to cause it to foam and cure. Any suitable foam, open or closed cell, plastic, ceramic or the like, may be used. The foam is preferably foamed in place after sidewalls 12 and 14 and wire 28 have been assembled. However, if desired, the foam block may be made in a separate mold, with wires 28 or metal sheets 29 embedded appropriately in the foam. Then, the foam block is lowered between sidewalls respectively sliding down into dovetail grooves 26.

Typical foam materials include polyurethane foams, heat expandable polystyrene beads, pourable polycarbanilide foam material (such as that available from the CPR Division of the Upjohn Company under the Poly-C 777 trademark), polyimide foams of the sort described by Gagliani et al. in U.S. Pat. No. 4,506,038, pourable mixtures of glass or ceramic microballoons with a suitable adhesive or premolded shapes from such materials.

In most cases, it is desirable to provide vertical open spaces in the block to permit filling with concrete and reinforcing rods after assembly into a wall. Any desired open spaces may be provided by conventional molding methods, such as by placing mold release coated plugs or cores in the block in the areas to be left empty. It is important, however, that the region around the overlap of web ends 18 and wire ends 32 be filled with foam to provide structural strength during shipping, handling and installation of the block. Excellent results are obtained where the vertical opening for later filing with concrete is provided along the inner face 34 of first sidewall 12. This provides excellent bonding of the introduced concrete to the concrete sidewall, which may be ribbed to increase bonding area it desired.

If desired, other openings may be provided in the foam, such as tubular channels for pipes, wires or the like. A horizontal and/or vertical opening 36 and 37 respectively may be molded with a mold release coated plug which is removed after cure of foam 33. Alternatively, a tube, pipe or electrical conduit may be used as the mold and may be permitted to bond to foam 33 and remain in place. Any suitable tube may be used, such as plastic, metal, paperboard, etc. These tubes may easily be used for conveying heated or cooled air for environmental heating or air conditioning purposes. This is particularly efficient since the foam surrounding the tube will serve to insulate the tube and reduce heat transfer to or from the circulating fluid.

Figure 8:
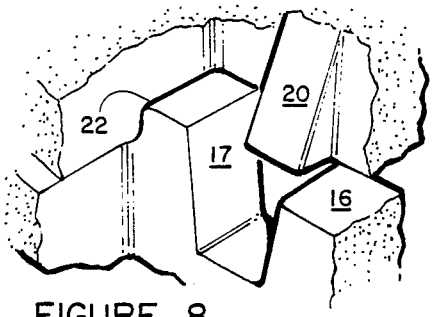
FIG. 8 is a detail perspective view illustrating the inter-block key arrangement.
Figure 7:
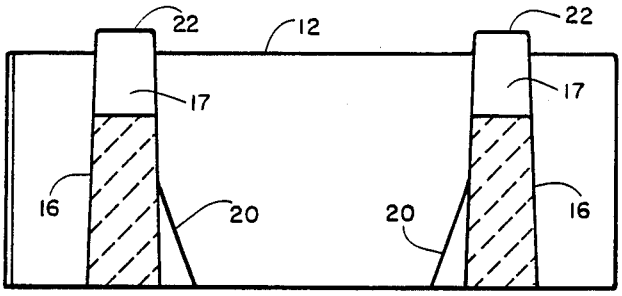
FIG. 7 is a section view taken on line 7—7 in FIG. 2.
Figure 9:
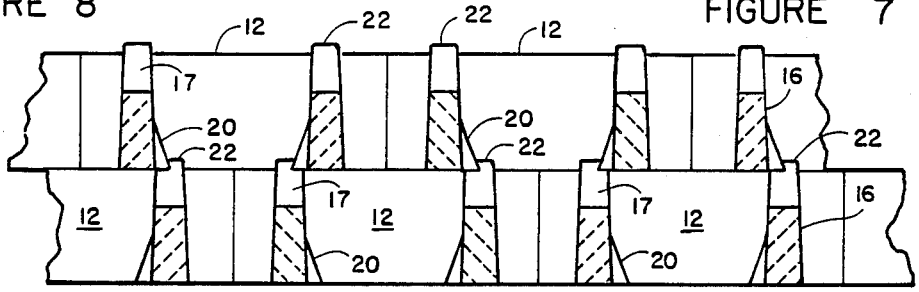
FIG. 9 is a section view through an assembled wall of blocks, each taken on lines corresponding to line 7—7 in FIG. 2.

A preferred method of assembling the blocks of my invention into walls is illustrated in FIGS. 7–9. FIGS. 7 and 9 are vertical section views through one block and an assembly of blocks taken along line 7—7 in FIG. 2. As mentioned above, each web 16 has a notch 17 along the upper edge and a correspondingly shaped extension 20 at the bottom edge. Extensions 20 are sized to fit snugly into notches 17 when the blocks are laid up into a wall, as seen in FIG. 9. Projections 22 extend upwardly into the block above contiguous with the inner face 34 of sidewall 14 to further stabilize the assembly. This provides a strong, stable interlocking relationship among the blocks is a wall when laid up without mortar. For further details on the preferred spacing of webs 16 and relationships between notches 17 and extensions 20, see my prior U.S. Pat. Nos. 4,640,071 and 3,880,060.

After a wall is completed and in use, it could be subject to high temperatures or flames in the event of a nearby fire. Most foam materials melt or burn at high temperatures. Many prior foam insulated building blocks tend to fall apart when foam melting occurs, causing a loss of wall strength and structural integrity to the extent that the wall is likely to collapse. With the building blocks of my invention, however, the sidewalls at most will move apart a very small distance until the overlapping end portions are in contact, retaining wall structural integrity and preventing wall collapse, and/or falling parts of the wall which could cause injury or damage to persons or objects near the wall.

Figure 10:
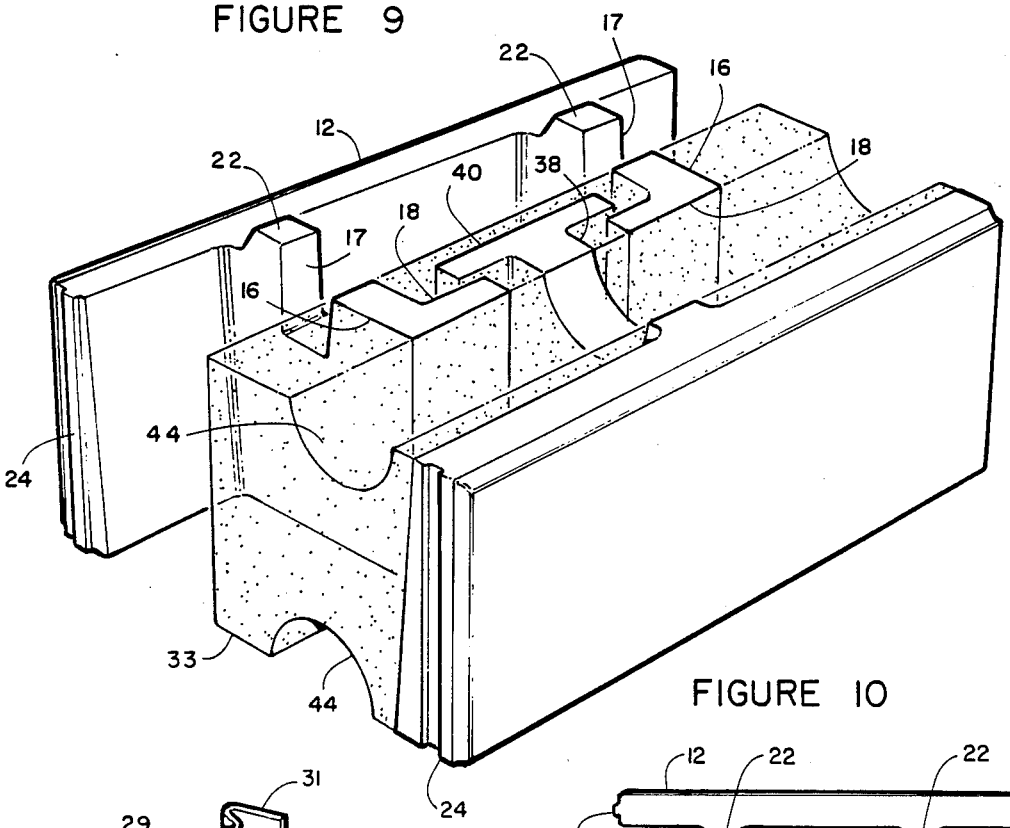
FIG. 10 is a perspective view, partially in phantom, of a second embodiment of my building block.
Figure 11:
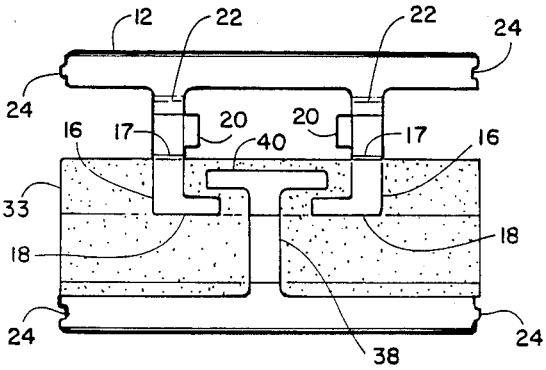
FIG. 11 is a plan view of the block of FIG. 10.

A second embodiment of my insulating building block is shown in FIGS. 10 and 11. Here, first sidewall 12 is identical with that shown in FIGS. 1–4, with inwardly extending upstanding webs 16, notches 17, end portions 18, extensions 20, projections 22 and tongue-and-groove ends 24.

Here, however, second sidewall 14 has an inwardly extending upstanding web 38 having an end portion 40 extending in both directions parallel to sidewall 14, in a "T"-shaped plan view. In this case, the block is assembled by lowering second sidewall 14 down into and over first sidewall 12 with "T"-shaped end portion 40 lying between and overlapping end portions 18, but with no contact between the overlapping end portions when sidewalls 12 and 14 are spaced apart the distance to provide the desired block width.

A casting mold can be used which forms both block walls and interlocking means at the same time. The sidewalls are arranged closer together, with the "T"-shaped end portion near the inside surface of sidewall 12. Many more of these closely spaced pairs can be handled with a given number of manufacturing pallets then when the components are molded separately. Typically, the components of a 12 inch thick block can be positioned with the outside of the walls 8 inches apart. After the components are formed and cured, the components are moved apart to their final positions and the foam introduced.

The cavity within the block is then partially or entirely filled with foam 33 as described above. Web 38 can be configured to permit the formation of a longitudinal duct or ducts during the foam application step. In the embodiment shown, half-circle notches 42 are provided in web 38 corresponding to half-circle channels 44 molded into foam 33. When blocks are assembled into a wall, full circle tubes will be formed, suitable for use as conduits for wires, pipes or the like.

Figure 12:
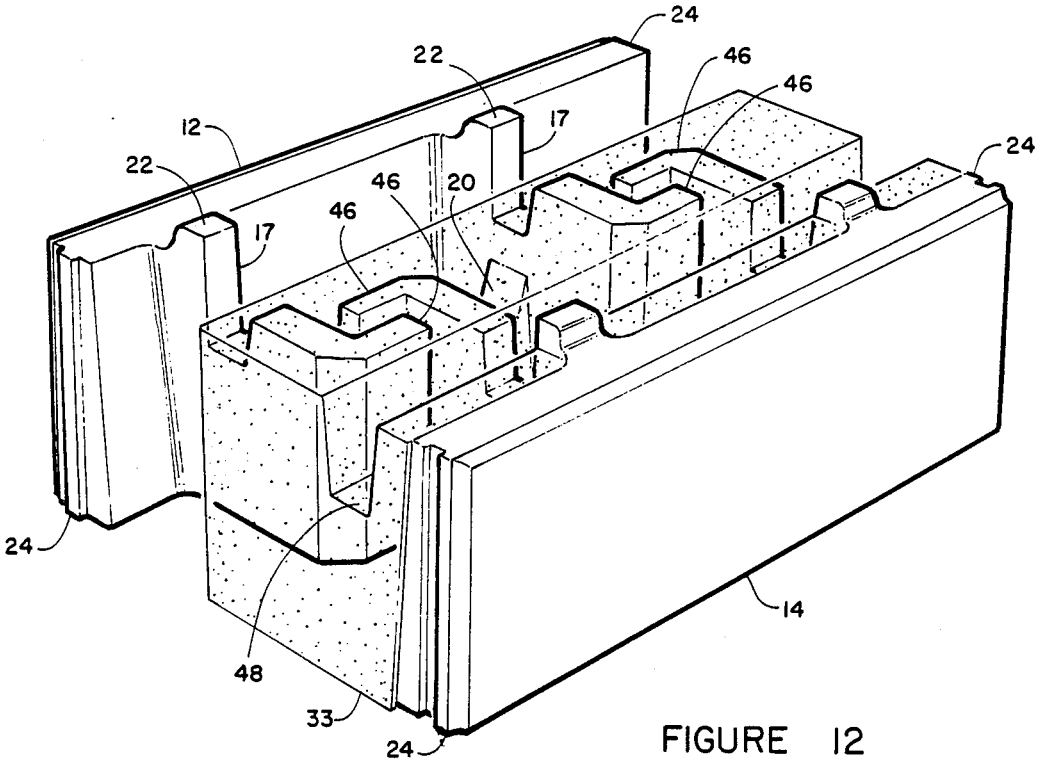
FIG. 12 is a perspective view, partially in phantom, of another embodiment of my building block.
Figure 13:
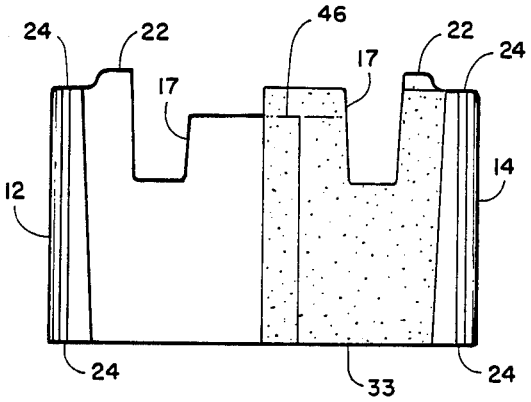
FIG. 13 is a left elevation view of the block of FIG. 12.
Figure 14:
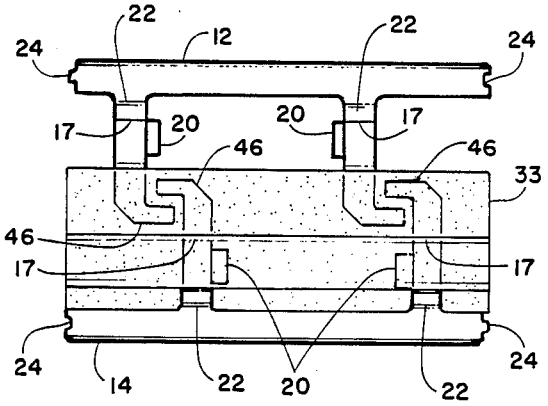
FIG. 14 is a plan view of the block of FIG. 12.
Figure 15:
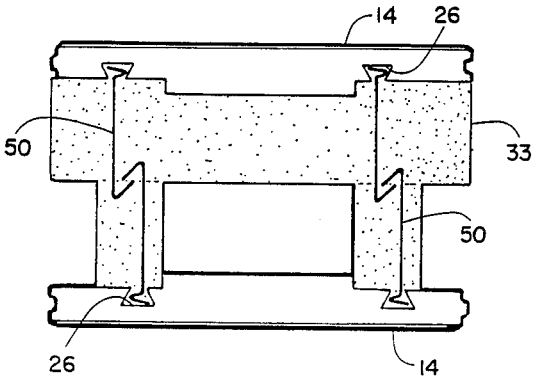
FIG. 15 is a plan view of a further another embodiment of my building block.
Figure 16:
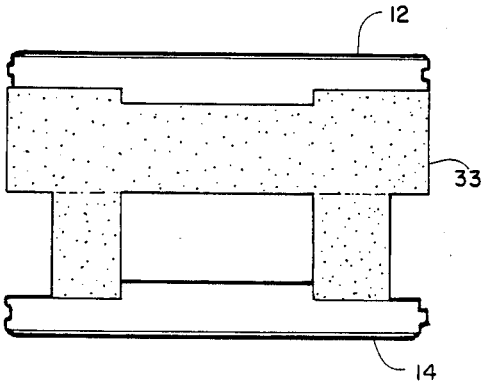
FIG. 16 is a plan view of still another embodiment of my building block.

Another embodiment of my insulating building block is shown in FIGS. 12–14. In this embodiment sidewalls 12 and 14 are identical. Here each sidewall includes a pair of inwardly extending webs 16, each having pairs of notches 17 and extensions 20, projections 22, and tongue-and-groove ends 24 as described above. In this case, however, both end portions 46 extend in the same direction. When the two sidewalls are placed together with the sidewalls the proper distance apart to provide the desired block width, each pair of opposed end portions 46 are out of contact, but overlap sufficiently that the sidewalls cannot be separated by movement along a line perpendicular to the sidewall exterior faces.

Because each web 16 includes a notch and extension 20, it is necessary that a channel 48 be formed in foam 33 corresponding in shape to notches 17 to accommodate extensions 20 when a wall is laid up as shown in FIG. 9.

The embodiment shown in FIGS. 12–14 has the advantage of simplicity in that only one sidewall mold is required. However, horizontal ducts cannot be incorporated as easily as with the other embodiments.

While certain preferred dimensions, materials and relationships were described in conjunction with the above description of preferred embodiments, these can be varied, where suitable, with similar results. For example, the blocks may have a variety of dimensions and other methods of bonding or interlocking blocks together may be used. Blocks may be formed from any suitable material such as concrete or ceramic materials, which may incorporate additives such as cinders, reinforcing fibers, weight reducing materials such as foam beads, microballoons, etc. The outer faces of the blocks are substantially parallel, but may slope or be otherwise configured for decorative purposes. The faces may have a plain prefinished surface, such as a split appearance, may be glazed or coated or may have various veneers such as wood, brick or metal applied thereto.

Other applications, ramifications and variations on my invention will occur to those skilled in the art upon reading this disclosure. Those are intended to be included within the scope of my invention as defined in the appended claims.

I claim:

1. A high strength, insulating building block having no thermal bridges of block structural material from one side to the other which comprises:

first and second spaced substantially planar sidewalls having substantially parallel outer faces;

said first sidewall having upstanding integral webs extending toward said second sidewall;

said first webs having first lateral end portions extending substantially parallel to said outer faces;

interlock means attached to the inner surface of said second sidewall and extending toward said first sidewall;

said interlock means including second lateral end portions extending substantially parallel to said outer faces and overlapping said first lateral end portions in a manner restricting separating movement of said sidewalls along a line substantially perpendicular to said outer faces;

said overlapping first and second lateral end portions being spaced from each other; and an insulating foam material filling at least part of the volume between said sidewalls including the space between said overlapping first and second lateral end portions and maintaining the spacing thereof.

2. The building block according to claim 1 wherein said interlocking means comprises:

a dovetail groove in the inner surface of said second sidewall opposite each of said first webs and lying substantially parallel thereto; and a wire member having a planar, zig-zag center section and two extending end sections with bent over end portions forming said second end portions;

whereby said wire member center section can be positioned in said dovetail groove with said end portions overlapping said first end portions.

3. The building block according to claim 1 wherein said interlocking means comprises:

a dovetail groove in the inner surface of said second sidewall opposite each of said first webs and lying substantially parallel thereto; and a sheet member having one ended folded into a shape capable of sliding into said groove and being trapped against removal along a line perpendicular to said faces and an opposite edge bent over to form said second end portion;

whereby said sheet member folded edge can be positioned in said dovetail groove with said end portions overlapping said first end portions.

4. The building block according to claim 1 wherein said interlocking means comprises:

at least one upstanding integral second web extending from said second sidewall toward said first sidewall;

at least one second lateral end portion on said second web extending substantially parallel to said outer faces and overlapping said first end portion.

5. The building block according to claim 4 wherein;

two first webs extend from said first sidewall;

the end portions at the end of said two first webs extend toward each other;

one second web extends from said second sidewall; and two second end portions at the end of said second web extend in opposite directions;

whereby said second web extends between said first webs with said second end portions overlapping said first end portions.

6. The building block according to claim 4 wherein:

at least two first webs extend from said first sidewall each with a first end portion extending in the same direction;

a corresponding number of upstanding integral second webs extending from said second sidewall towards said first sidewall;

each of said second webs having a second lateral end portion extending substantially parallel to said outer faces;

each of said second end portions extending in the same direction and overlapping a corresponding first end portion.

7. The building block according to claim 6 wherein all of said first and second sidewalls and integral webs are identical in configuration.

8. The building block according to claim 1 wherein said first webs include a notch along one edge and a corresponding extension along the second edge whereby in assembling such blocks into a wall, extensions fit within notches of adjacent blocks to interlock the blocks.

9. The building block according to claim 1 wherein at least some of said first webs include upwardly extending projections adjacent to the sidewall adapted to interlock with adjacent blocks when such blocks are assembled into a wall.

10. The building block according to claim 1 further including openings through said foam adapted to interconnect with openings in adjacent blocks when such blocks are assembled into a wall.

11. The building block according to claim 1 including at least one vertical opening adjacent to at least one sidewall adapted to receive concrete and reinforcing material when such blocks are assembled into a wall.

12. A high strength, insulating building block having no thermal bridges of block material from one side to the other which comprises:

first and second spaced substantially planar sidewalls having substantially parallel outer faces;

the inner surfaces of said first and second sidewalls each having at least one dovetail groove;

each groove engaging an interlocking member having a first end configured to slidably fit within said groove and a second end bent over and configured to overlap but not contact a similarly bent end of the interlock member engaging the corresponding groove in the opposite sidewall; and an insulating foam material filling part of the volume between said sidewalls with said interlocking members embedded in said foam in an overlapping but non-contacting arrangement.

13. The block according to claim 12 wherein said interlock member comprises a wire member having a planar, zig-zag center section and two extending end sections with bent over ends, said center section adapted to slidably fit within said groove and resist withdrawal therefrom along a line approximately perpendicular to the sidewall inner surface.

14. The block according to claim 12 wherein said interlock member comprises a sheet member having one end folded into a shape capable of sliding into said groove and being trapped against removal along a line approximately perpendicular to the sidewall inner surface and having an opposite bent over edge.

15. A high strength, insulating building block for vertical and horizontal adjacent stacking having no thermal bridges of block material from one side to the other which comprises:

first and second spaced apart substantially planar sidewalls having substantially parallel outer faces; and an insulating foam material filling a portion of the space between said sidewalls and bonded to said sidewalls;

said foam having at least one vertical opening surrounded by foam and a portion of one sidewall;

whereby openings in vertically adjacent blocks are adapted to receive concrete and reinforcing material during assembly of a wall from said blocks.

* * * * *